US008096843B2

(12) United States Patent
Gong

(10) Patent No.: US 8,096,843 B2
(45) Date of Patent: Jan. 17, 2012

(54) ELECTRICAL CONNECTOR

(75) Inventor: Jin-Long Gong, Kunshan (CN)

(73) Assignee: Hon Hai Precision Ind. Co., Ltd, New Taipei (TW)

( * ) Notice: Subject to any disclaimer, the term of this patent is extended or adjusted under 35 U.S.C. 154(b) by 0 days.

(21) Appl. No.: 12/766,124

(22) Filed: Apr. 23, 2010

(65) Prior Publication Data

US 2010/0273345 A1 Oct. 28, 2010

(30) Foreign Application Priority Data

Apr. 23, 2009 (CN) ..... 2009 2 0302500

(51) Int. Cl.
*H01R 13/53* (2006.01)

(52) U.S. Cl. ..... 439/856

(58) Field of Classification Search ..... 439/856, 439/181, 678, 680, 780
See application file for complete search history.

(56) References Cited

U.S. PATENT DOCUMENTS 5,582,519 A 12/1996 Buchter
6,488,549 B1 * 12/2002 Weller et al. ..... 439/856
7,083,433 B2 * 8/2006 Misawa et al. ..... 439/80

* cited by examiner

*Primary Examiner* — Alexander Gilman
(74) *Attorney, Agent, or Firm* — Wei Te Chung; Andrew C. Cheng; Ming Chieh Chang

(57) ABSTRACT

An electrical connector (200) includes a housing (30) having a number of contact cavities (34) and a number of contacts (20) upwardly inserted respectively into said contact cavities (34). Each of the contacts (20) has a lower section (22) and two upper contact beams (24, 26). The lower section (22) includes a center fixing portion (225), two end fixing portions (224, 226), and two connecting portions (228, 229) connected between the center fixing portion (225) and the two end fixing portions (224, 226). The two upper contact beams (24, 26) respectively extend upwardly from the two connecting portions (228, 229). The two end fixing portions (224, 226) and the center fixing portion (225) are fixed to the housing (30).

20 Claims, 7 Drawing Sheets

ELECTRICAL CONNECTOR

BACKGROUND OF THE INVENTION

1. Field of the invention

The present invention relates to an electrical connector, and particularly, to an electrical power connector.

2. Description of Related Art

U.S. Pat. No. 5,582,519, issued to Buchter on Dec. 10, 1996, discloses an electrical connector assembly. The electrical connector assembly comprises blade connector and a receptacle connector mating with the blade connector. The blade connector comprises an insulating housing containing power or signal blade contacts having contact blades and a ground blade contact having a contact blade. A tab projects in the mating direction from the forward edge of the ground contact blade. The receptacle connector has an insulating housing with receptacle contacts disposed in respective cavities in the housing. Each receptacle contact has contact springs having contact surfaces. The receptacle contact in the center cavity is a ground receptacle contact, whilst the receptacle contacts in the remaining cavities are power or signal contacts. When the connectors are mated, the tab first engages the ground receptacle contact in the center cavity and thus makes the ground circuit of the connector assembly. The forward edges of the contact blades then pass substantially simultaneously between the contact surfaces of the respective receptacle contacts and the tab is received in an opening defined between the contact springs of the ground receptacle contact. Upon unmating of the connectors the tab is withdrawn from the contact surfaces of the ground receptacle contact after the contact blades have been withdrawn from the receptacle contact. The receptacle contact has a base having two opposite ends fixed to the insulating housing and an intermediate portion between the two ends. The intermediate portion might produce undesired distortion.

So there is a need for a new type of electrical connector to overcome this problem.

SUMMARY OF THE INVENTION

An object of the present invention is to provide an electrical connector. The electrical connector includes a housing having a number of contact cavities and a number of contacts upwardly inserted respectively into the contact cavities. Each of the contacts has a lower section and two upper contact beams. The lower section includes a center fixing portion, two end fixing portions and two connecting portions connecting between the center fixing portion and corresponding end fixing portions. The two upper contact beams respectively extend upwardly from the two connecting portions. The two end fixing portions 224, 226 and the center fixing portion 225 are fixed to the housing 30.

Still another object of the present invention is to provide another electrical connector. The electrical connector includes a housing defining a plurality contact cavities and a plurality of contacts upwardly inserted respectively into said contact cavities. Each of the contacts comprises a lower portion for fastening the contact in the housing and being substantially disposed in a first vertical plane, a first upper contact beam and a second upper contact beam upwardly extending from the lower portion and being offset from said first vertical plane. Each of the first and the second upper contact beams has a free end for contacting a mating contact.

Other objects, advantages and novel features of the invention will become more apparent from the following detailed description of a preferred embodiment when taken in conjunction with the accompanying drawings.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
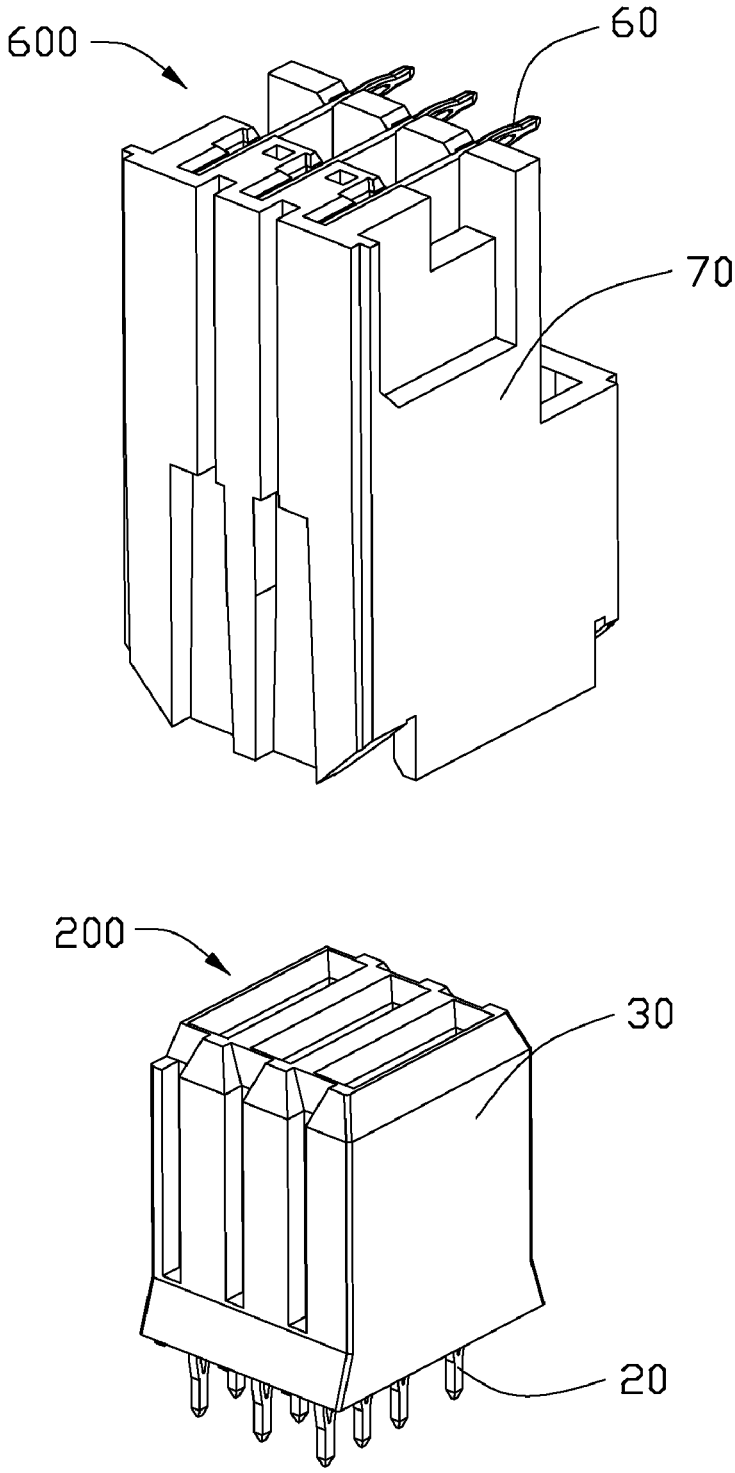
FIG. 1 is a perspective view of an electrical connector and a mating electrical connector according to the present invention.

Reference will now be made to the drawing figures to describe the present invention in detail.

Figure 2:
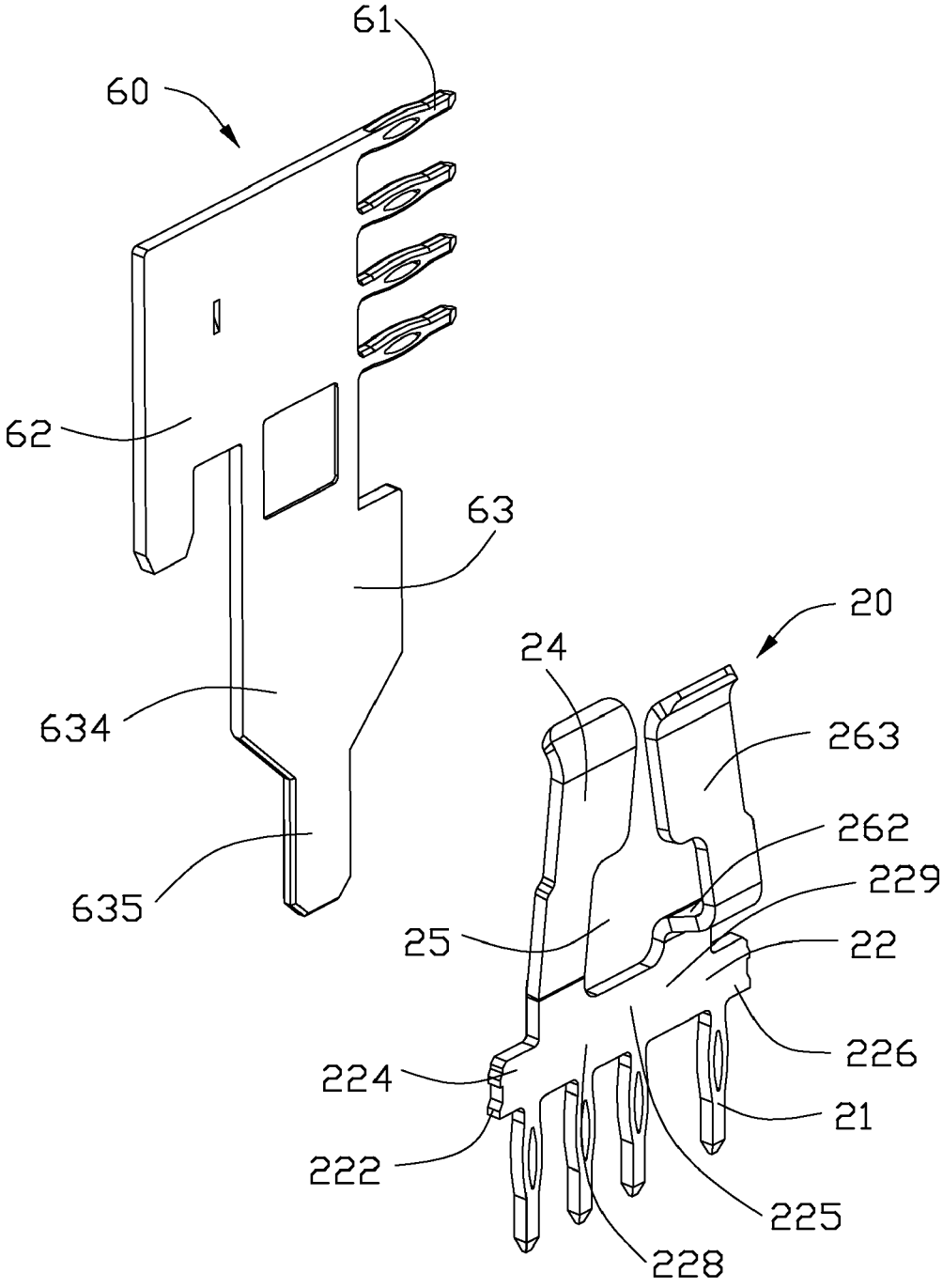
FIG. 2 is a perspective view of a contact of the electrical connector and a mating contact of a mating electrical connector shown in FIG. 1.
Figure 3:
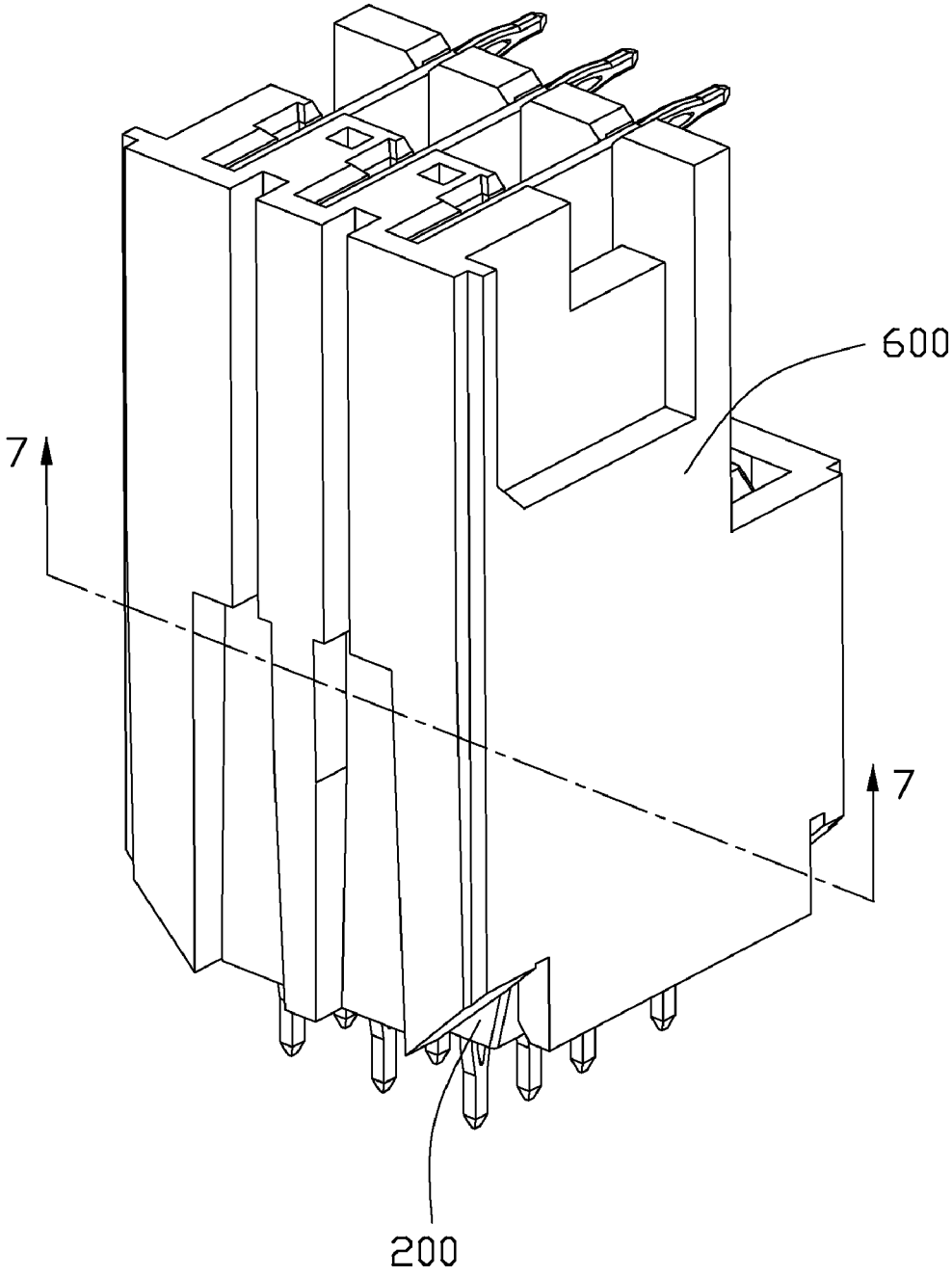
FIG. 3 is a perspective view of the electrical connector and the mating electrical connector shown in FIG. 2, in a mated position.
Figure 4:
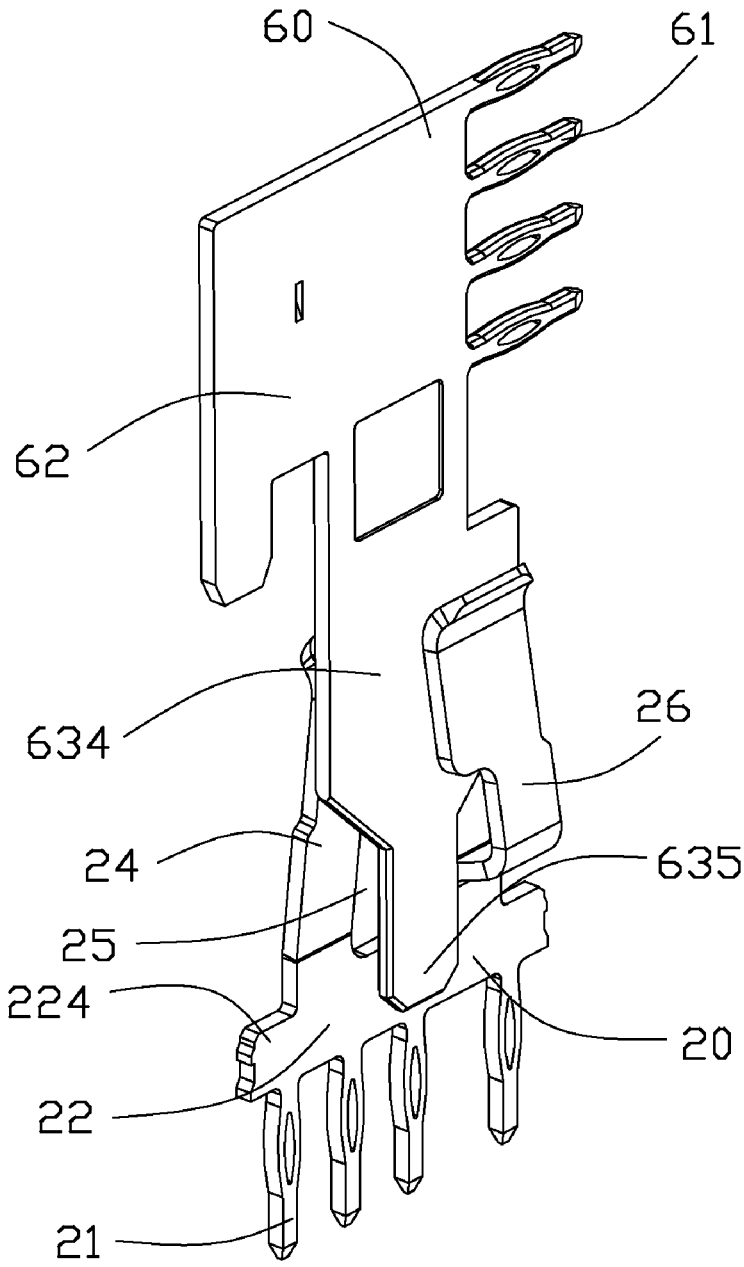
FIG. 4 is a perspective view of a contact of the electrical connector and a mating contact of a mating electrical connector shown in FIG. 3.
Figure 5:
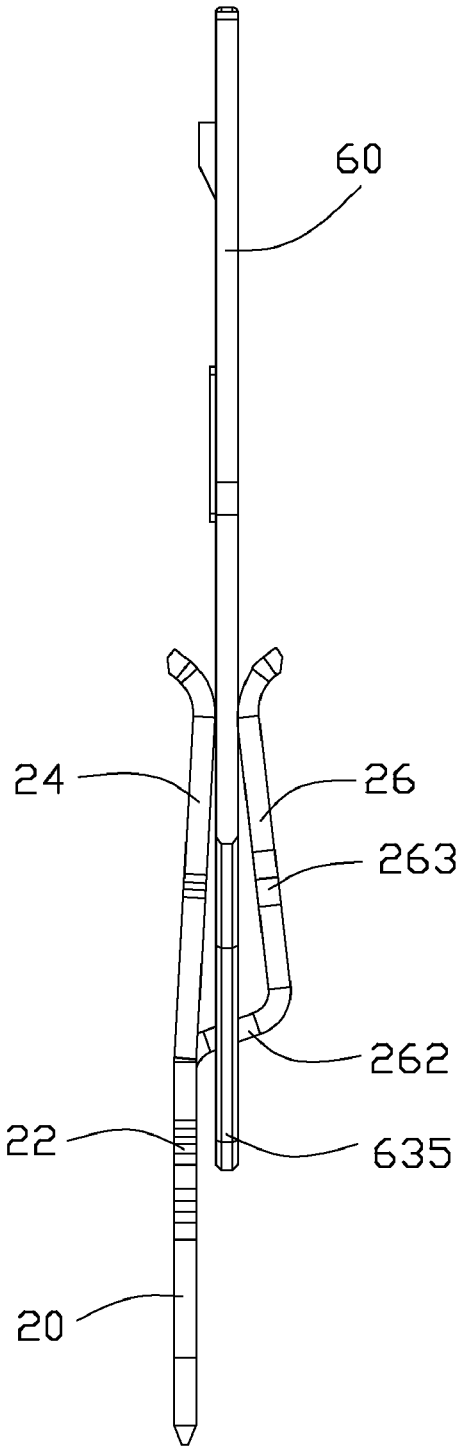
FIG. 5 is a side view of the contacts shown in FIG. 4.
Figure 6:
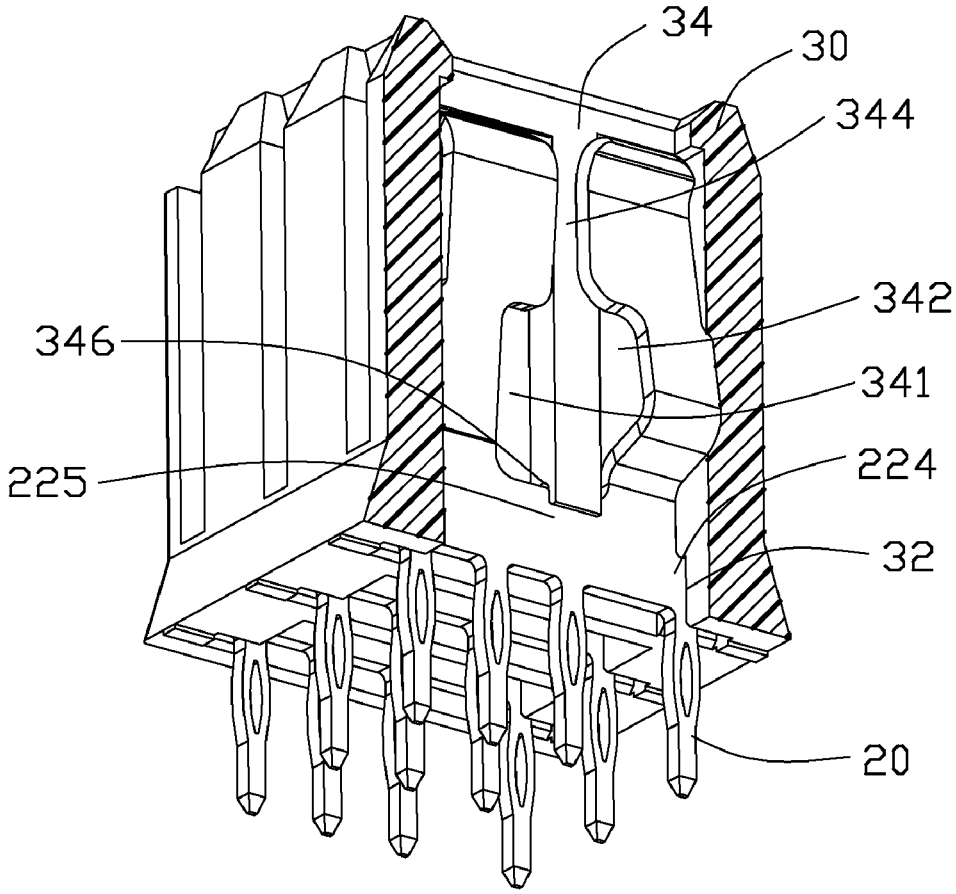
FIG. 6 is a perspective view of the electrical connector shown in FIG. 1, with a portion of the housing cut away to show the contact in the housing.
Figure 7:
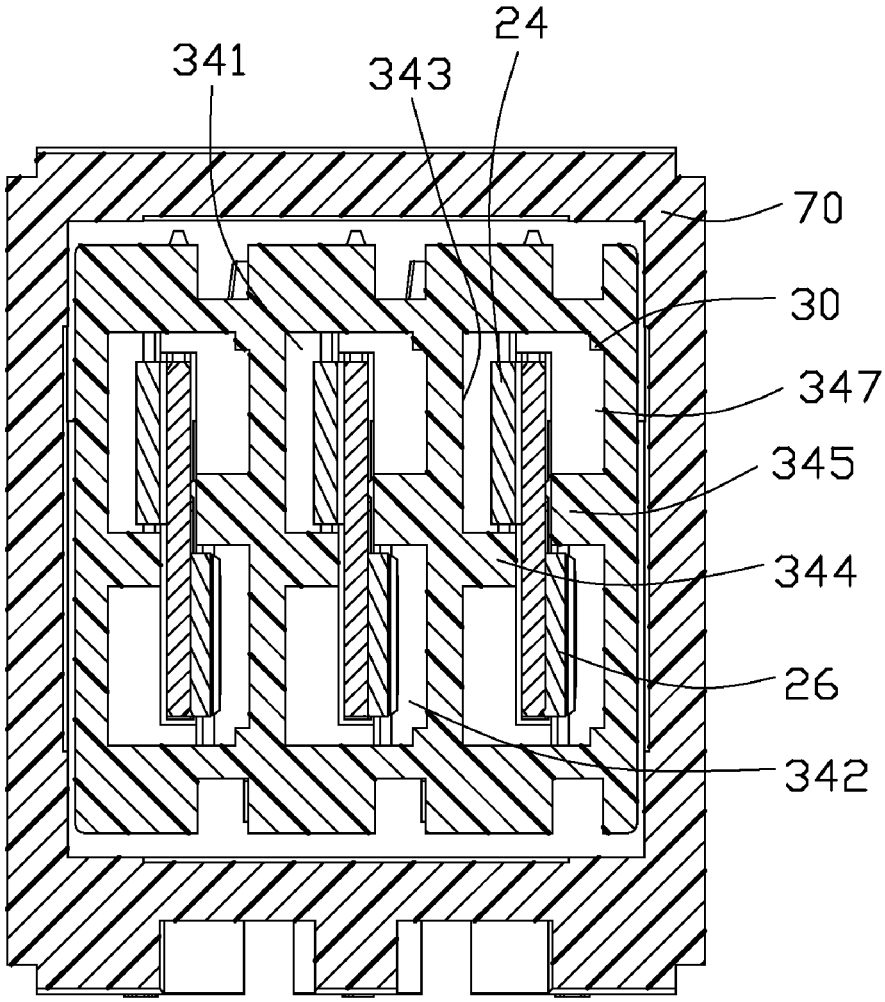
FIG. 7 is a cross-section of the electrical connector and the mating electrical connector shown in FIG. 3.

Referring to FIGS. 1-7, an electrical connector 200 and a mating electrical connector 600 are shown.

The electrical connector 200 comprises an insulating housing 30 having three contact cavities 34 and three contacts 20 upwardly inserted respectively into said contact cavities 34. Each of the contacts 20 has a lower section 22 disposed substantially in a first vertical plane, a first upper contact beam 24 and a second upper contact beam 26. The lower section 22 comprises a center fixing portion 225, two end fixing portions 224, 226 and two connecting portions 228, 229 connecting between the center fixing portion 225 and corresponding end fixing portions 224, 226. The two upper contact beams 24, 26 respectively extend upwardly from the two connecting portions 228, 229. The two end fixing portions 224, 226 and the center fixing portion 225 engage the housing 30 thereby fixing the contact 20 to the housing 30.

The contact cavity 34 of the housing 30 has a first side 343 and an opposite second side 347 parallel to the first vertical plane. The first upper contact beam 24 and the second upper contact beam 26 jointly define a center window 25 therebetween. The two upper contact beams 24, 26 are offset away relative to the lower portion in a direction from the first side 343 to the second side 347. The two upper contact beams 24, 26 and the lower section 22 are so configured that when a mating contact 60 is downwardly inserted into corresponding contact cavity 34 and mated with the two upper contact beams 24, 26, a tip portion 635 of the mating contact 60 gets through the center window 25 and reaches a position beside the lower portion 22.

The housing 30 has a first rib 344 formed on the first side 343 of the cavity 34, said first rib 344 defining a slot 346 receiving the center fixing portion 225 therein. The housing 30 defines a pair of slots 32 for respectively receiving the two end fixing portions 222, 224. The second side 347 protrudes a second rib 345 to work together with the first rib 344 for guiding the insertion of the mating contact 60.

The first upper contact beam 24 and the second rib 345 are offset to a first direction and abut to each other when the mating contact 60 is unmated. The second upper contact beam 26 and the first ribs 344 are offset to a second direction opposite to the first direction and abut to each other when the mating contact 60 is unmated. The first rib 344 and the second rib 345 divide the contact cavity 34 into two sub-cavities 341, 342 respectively receiving the first and the second upper contact beams 24, 26.

Each of the two end fixing portions 224, 226 has two teeth 222 for interference mating with the housing 20. The contact 20 further comprises four pins 21 downwardly extending from the lower portion 22 for press-fit mating into a printed circuit board. Each of the two end fixing portions 224, 226 horizontally extends beyond corresponding upper contact beam 24, 26. The two end fixing portions 224, 226 and the center fixing portion 225 are downwardly pressed by the housing 30 when the electrical connector 100 is press-fit mounted onto the printed circuit board.

The second upper contact beam 26 comprises a first slant portion 262 extending away from the first vertical plane and a second slant portion 263 continuously extending toward the first vertical plane. The first upper contact beam 24 is disposed at a side of a second vertical plane perpendicular to the first vertical plane and the second upper contact beam 26 is disposed at an opposite side of the second vertical plane.

The mating electrical connector 600 includes a housing 70 and three mating electrical contacts 60. Each of the mating contacts 60 includes a fastening portion 62 and a mating portion 63 downwardly extending from the fastening portion 62 and four pins 61 extending sideway. The mating portion 63 further includes a rear contacting portion 634 having a first width and a front guide portion 635 having a second width narrower than the first width.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a housing having a plurality of contact cavities, said contact cavity of the housing having a first side and an opposite second side, a first rib protruding from the first side;

a plurality of contacts upwardly inserted respectively into said contact cavities, each of the contacts having a lower section and two upper contact beams, said lower section comprising a center fixing portion, two end fixing portions and two connecting portions connecting between the center fixing portion and corresponding end fixing portions, said two upper contact beams respectively extending upwardly from the two connecting portions;

wherein the two end fixing portions are fixed to the housing and the center fixing portion being positioned by said first rib.

2. An electrical connector as claimed in claim 1, wherein said contact cavity of the housing has a first side and an opposite second side, the two upper contact beams are offset relative to the lower section in a direction away from the first side to the second side, when a mating contact is downwardly inserted into corresponding contact cavity and mated with the two upper contact beams, a tip portion of the mating contact reaches a position beside the center fixing portion.

3. An electrical connector as claimed in claim 2, wherein, said first rib defines a slot receiving said center fixing portion therein.

4. An electrical connector as claimed in claim 3, wherein said second side protrudes a second rib to work together with the first rib for guiding insertion of the mating contact.

5. An electrical connector as claimed in claim 4, wherein the first and the second ribs and the two upper contact beams are so configured that the first rib abuts one of the two upper contact beams and the second rib abuts the other when the mating contact is unmated.

6. An electrical connector as claimed in claim 4, wherein the first rib and the second rib divide the contact cavity into two sub-cavities respectively receiving the first and the second upper contact beams.

7. An electrical connector as claimed in claim 1, wherein each of the two end fixing portions has a plurality of teeth for interference mating with the housing, the lower portion being disposed substantially in a first vertical plane, the teeth of the two end fixing portions oppositely protruding along the first vertical plane.

8. An electrical connector as claimed in claim 7, wherein the contact comprises a plurality of pins downwardly extending from the lower section for press-fit mating into a printed circuit board.

9. An electrical connector as claimed in claim 8, wherein each of the two end fixing portions extends beyond a corresponding upper contact beam, the two end fixing portions and the center fixing portion being downwardly pressed by the housing when the electrical connector is press-fit mounted onto the printed circuit board.

10. An electrical connector comprising a housing defining a plurality of contact cavities each extending through the housing in a vertical direction and defining a cross-section with thereof a longitudinal direction and a transverse direction perpendicular to each other and commonly perpendicular to said vertical direction;

a plurality of contacts upwardly inserted respectively into said contact cavities;

wherein each of the contacts comprises a lower portion fastened in one cavity of the housing and substantially disposed in a first vertical plane perpendicular to the longitudinal direction, a first upper contact beam and a second upper contact beam upwardly extending from the lower portion and being offset from said first vertical plane, the first upper contact beam having a free end contacting a side of a mating contacts, the second upper contact beam having another free end contacting an opposite side of the mating contact;

wherein the free end of the first upper contact beam is offset from the free end of the second upper contact beam in the transverse direction.

11. An electrical connector as claimed in claim 10, wherein the first upper contact beam and the second upper contact beam define a center window therebetween for passage by a mating contact to reach a position beside the lower portion when the mating contact is mated.

12. An electrical connector as claimed in claim 11, wherein the second upper contact beam comprises a first slant portion extending away from the first vertical plane and a continuing second slant portion continuously extending toward the first vertical plane.

13. An electrical connector as claimed in claim 11, wherein the first upper contact beam is disposed at a side of a second vertical plane perpendicular to the first vertical plane and the second upper contact beam is disposed at an opposite side of the second vertical plane.

14. An electrical connector as claimed in claim 13, wherein said lower section comprises a center fixing portion, two end fixing portions, and two connecting portions connected between the center fixing portion and corresponding end fixing portions, said two upper contact beams respectively extending upwardly from the two connecting portions, the two end fixing portions and the center fixing portion engaging to the housing.

15. An electrical connector assembly comprising:

a first connector including:

an insulative housing defining a plurality of passageways each extending through the housing in a vertical direction and defining a cross-section with thereof a longitudinal direction and a transverse direction perpendicular to each other and commonly perpendicular to said vertical direction;

a plurality of first contacts disposed in the corresponding passageways, respectively;

each of said contacts defining a lower retaining portion extending in a vertical plane to retain to the housing, a first upper contact beam and a second upper contact beam laterally spaced from each other in said longitudinal direction while extending upwardly from a common upper half of the lower retaining portion in an lateral offset manner along the same lateral direction so as to be located by a same side of said vertical plane for receiving a blade type terminal of a second connector therebetween; wherein the housing forms a first rib in each of said passageways, and said rib is located beside the first upper contact beam in said longitudinal direction while being opposite to the second upper contact beam in said transverse direction.

16. The electrical connector assembly as claimed in claim 15, wherein the housing further forms a second rib located beside the second upper contact beam in said longitudinal direction while being opposite to the first upper contact beam in said transverse direction.

17. The electrical connector assembly as claimed in claim 16, wherein a gap is defined between the first rib and the second rib in the transverse direction for receiving the blade type terminal of the second connector therein.

18. The electrical connector assembly as claimed in claim 15, wherein said first upper contact beam is closer to the vertical plane than the second upper contact beam in said transverse direction.

19. The electrical connector assembly as claimed in claim 18, wherein in a periphery of each of said passageways, the housing defines a pair of opposite longitudinal walls in said longitudinal direction, and the first rib is formed on the one of said longitudinal walls.

20. The electrical connector assembly as claimed in claim 19, wherein the housing further forms a second rib located beside the second upper contact beam in said longitudinal direction while being opposite to the first upper contact beam in said transverse direction, and said second rib is formed on the other of said longitudinal walls.

* * * * *